US005707586A

United States Patent [19]

McMann

[11] Patent Number: 5,707,586

[45] Date of Patent: Jan. 13, 1998

[54] FREE MACHINING STAINLESS STEEL AND COMPONENTS FOR AUTOMOTIVE FUEL AND EXHAUST SYSTEMS MADE THEREFROM

[75] Inventor: Fred W. McMann, Novi, Mich.

[73] Assignee: CRS Holdings, Inc., Wilmington, Del.

[21] Appl. No.: 574,613

[22] Filed: Dec. 19, 1995

[51] Int. Cl.[6] ..... C22C 38/26; C22C 38/60

[52] U.S. Cl. ..... 420/42; 420/70; 148/325

[58] Field of Search ..... 420/42, 70; 148/325

[56] References Cited

U.S. PATENT DOCUMENTS

| | | | |
|---|---|---|---|
| 3,401,035 | 9/1968 | Moskowitz et al. | 148/325 |
| 5,470,402 | 11/1995 | Nishino et al. | 148/325 |

OTHER PUBLICATIONS

Material Specification No. 1289 for "Chrome Stainless Steel Wire –409Cb" (circa. 1991).

Thomas et al., "Weld Heat–Affected Zone Properties in AISI 409 Ferritic Stainless Steel", *Toughness of Ferritic Stainless Steels*, ASTM STP 706, R.A. Lula, Ed., Am. Soc. for Testing Mat'ls 1980 (pp. 161–163) Raw Material Purchasing Specification for Type 409Cb welding rod (circa. Apr. 1994).

*Primary Examiner*—Deborah Yee

*Attorney, Agent, or Firm*—Dann, Dorfman, Herrell and Skillman, P.C.

[57] ABSTRACT

A ferritic stainless steel alloy is disclosed having a unique combination of machinability, cold-formability, weldability, and corrosion resistance. The disclosed alloy has the following weight percent composition.

| | wt. % |
|---|---|
| Carbon | 0.08 max. |
| Manganese | 1.00 max. |
| Silicon | 1.00 max. |
| Phosphorus | 0.045 max. |
| Sulfur | 0.030–0.30 |
| Chromium | 10.5–11.75 |
| Molybdenum | 0.50 max. |
| Copper | 0.50 max. |
| Nickel | 0.50 max. |
| Aluminum | 0.10 max. |
| Columbium | 10 × C to 0.80 |

The balance is essentially iron. The novel alloy is particularly suited for components used in automotive fuel and exhaust systems. A number of such components made from the aforesaid alloy are also disclosed.

15 Claims, 2 Drawing Sheets

FREE MACHINING STAINLESS STEEL AND COMPONENTS FOR AUTOMOTIVE FUEL AND EXHAUST SYSTEMS MADE THEREFROM

FIELD OF THE INVENTION

This invention relates to corrosion resistant components used in automotive fuel and exhaust systems, and in particular, to a corrosion resistant steel alloy for use in such components which provides a unique combination of machinability, cold formability, and weldability.

BACKGROUND OF THE INVENTION

A corrosion resistant steel alloy known as Type 409Cb has been used for fabricating components for automotive fuel and exhaust systems. Among the components made from Type 409Cb alloy are housings and bushings for oxygen sensors, and nuts and fittings for fuel filters. A known specification for Type 409Cb alloy is as follows, in weight percent.

| | |
|---|---|
| Carbon | 0.06 max. |
| Manganese | 1.00 max. |
| Silicon | 1.00 max. |
| Phosphorus | 0.045 max. |
| Sulfur | 0.045 max. |
| Chromium | 10.5–11.75 |
| Nickel | 0.50 max. |
| Columbium | 10 × C to 0.75 |
| Iron | Balance |

Parts made from Type 409Cb alloy are cold-formed or headed to rough shape from wire or another elongated form of the alloy. Consequently, the alloy is made with very low sulfur, 0.020% or less, in order to avoid the adverse effect of sulfur on the cold-formability of the alloy.

The headed blank is then machined to final size and shape. Among the machining operations performed on the headed blanks are drilling, tapping, facing, turning, form-tool shaping, and chamfering. In the as-headed condition, Type 409Cb is relatively soft and gummy. When it is machined, the steel chips removed by the machining tool are quite stringy in form. Such stringy chips are detrimental to the useful life of the machining tool because they accumulate around the tool and restrict the flow of cooling fluid to the tool and the part being machined. The tool then becomes overheated, loses its ability to remove metal from the part being machined, and must be removed for resharpening. If the tool overheats too rapidly, it can fail catastrophically. In either case, the result is undesirably frequent machine down-times and a concurrent loss in productivity.

In view of the foregoing circumstances, it would be desirable to have a corrosion resistant steel alloy that is readily cold-formable, as by heading, and which provides better machinability than the commercially available forms of Type 409Cb alloy.

SUMMARY OF THE INVENTION

In accordance with one aspect of the present invention there is provided a ferritic stainless steel alloy having a unique combination of cold-formability and machinability. The alloy consists essentially of, in weight percent, about:

| | wt. % |
|---|---|
| Carbon | 0.08 max. |
| Manganese | 1.00 max. |
| Silicon | 1.00 max. |
| Phosphorus | 0.045 max. |
| Sulfur | 0.030–0.30 |
| Chromium | 10.5–11.75 |
| Molybdenum | 0.50 max. |
| Copper | 0.50 max. |
| Nickel | 0.50 max. |
| Aluminum | 0.10 max. |
| Columbium | 10 × C to 0.80 |

and the balance is essentially iron and the usual impurities found in similar grades of ferritic stainless steels.

In accordance with another aspect of the present invention there is provided an article of manufacture for use in an automotive fuel or exhaust system. The article according to this invention includes a metallic body having an axial bore formed therein. A plurality of threads are formed on the metallic body so that it can be threaded onto a second article having a mating thread. The metallic body is formed of a corrosion resistant, ferritic steel alloy having the weight percent composition set forth in the immediately preceding paragraph.

Here and throughout this application the term "percent" or "%" means percent by weight unless otherwise indicated.

BRIEF DESCRIPTION OF THE DRAWINGS

Further novel features and advantages of the present invention will become apparent from the following detailed description and the accompanying drawings in which.

DETAILED DESCRIPTION

Figure 1A:
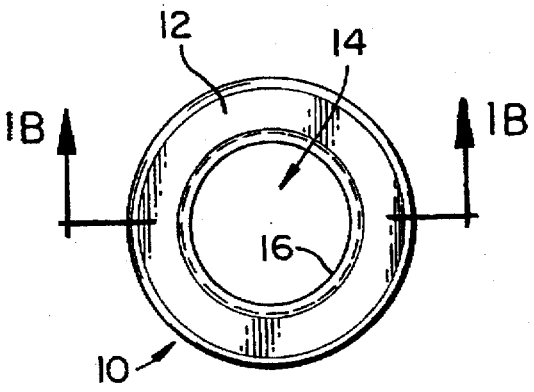
FIG. 1A is a plan view of a first embodiment of an article in accordance with the present invention in the form of a bushing for an oxygen sensor.
Figure 1B:
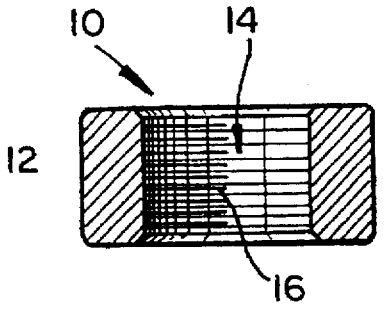
FIG. 1B is cross-sectional view of the bushing of FIG. 1A as viewed along line B—B therein.

Referring now to FIGS. 1A, 1B, and 1C, there is shown a first embodiment of an article according to the present invention in the form of a bushing 10 for an engine exhaust oxygen sensor. The bushing 10 has a generally ring-shaped metallic body 12 and a central axial bore 14. A plurality of internal threads 16 are formed about the inner periphery of the metallic body 12 so that another article having a mating external thread can be threaded into the bushing 10.

Figure 2A:
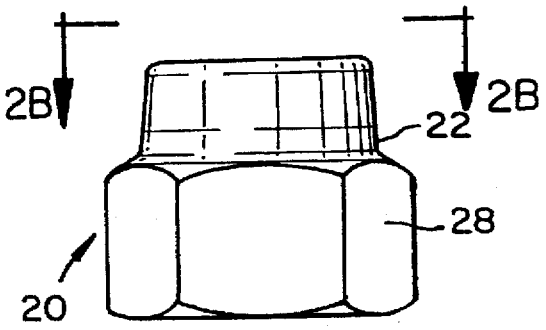
FIG. 2A is a side elevation view of a second embodiment of an article in accordance with the present invention in the form of a fitting for a fuel filter.
Figure 2B:
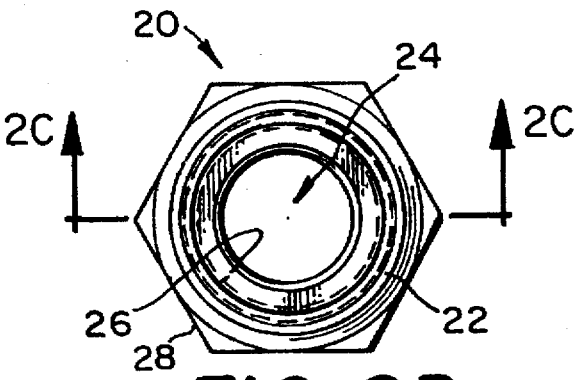
FIG. 2B is a top plan view of the fitting shown in FIG. 2A as viewed along line B—B therein.
Figure 2C:
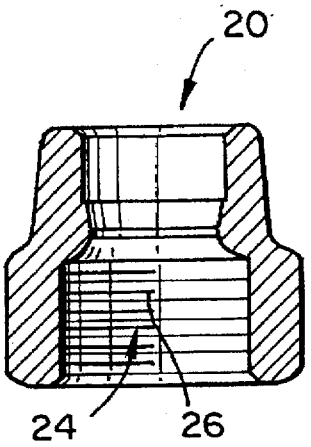
FIG. 2C is a cross-sectional view of the fitting shown in FIGS. 2A and 2B as viewed along line C—C in FIG. 2B.

Referring now to FIGS. 2A, 2B, and 2C, there is shown a second embodiment of an article according to the present invention in the form of a fuel filter fitting 20. The fitting 20 has a generally cylindrically-shaped metallic body 22 and a central axial bore 24. A plurality of internal threads 26 are formed about the inner periphery of one portion of the metallic body 22 so that the fitting 20 can be threaded onto a fuel filter (not shown) having mating external threads. Flats 28 are preferably formed on the external surface of the metallic body 22 so that a tool such as a wrench can be applied to the metallic body for rotating it as it is threaded onto the fuel filter.

Figure 3A:
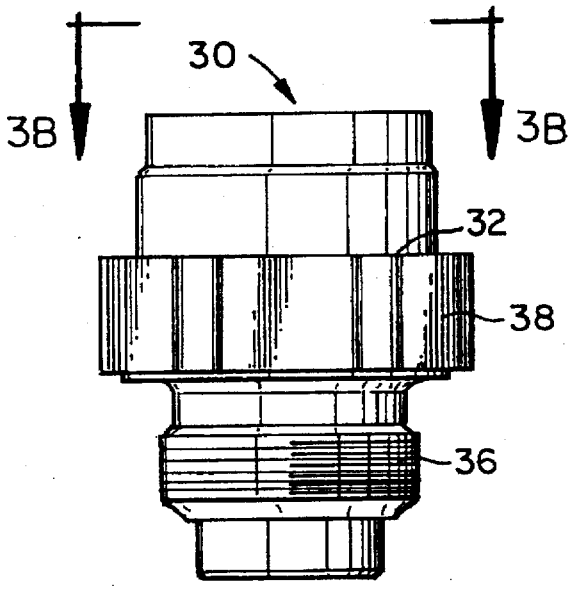
FIG. 3A is a side elevation view of a third embodiment of an article in accordance with the present invention in the form of a housing for an oxygen sensor.
Figure 3B:
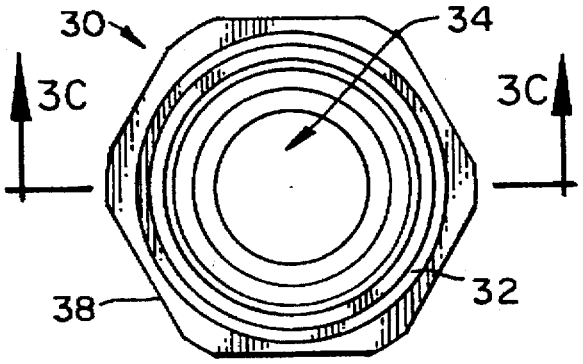
FIG. 3B is a top plan view of the housing shown in FIG. 3A as viewed along line B—B therein.
Figure 3C:
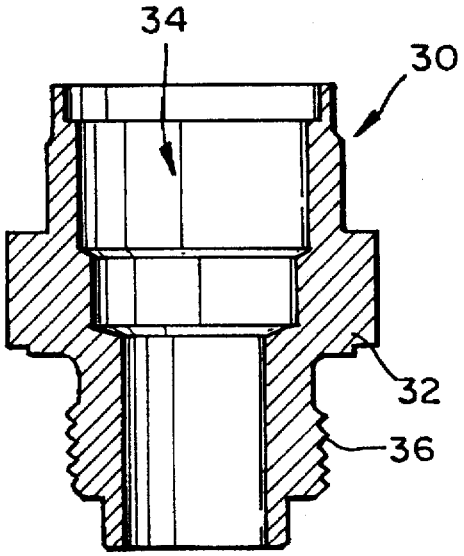
FIG. 3C is a cross-sectional view of the housing shown in FIGS. 3A and 3B as viewed along line C—C in FIG. 3B.

Referring now to FIGS. 3A, 3B, and 3C, there is shown a further embodiment of an article according to the present invention in the form of a housing or shell 30 for an engine oxygen sensor. The housing 30 has a generally cylindrically-shaped metallic body 32 and a central axial bore 34. A plurality of external threads 36 are formed about the external periphery of a first portion of the metallic body 32 so that the housing 30 can be threaded into another article (not shown) having mating internal threads. Flats 38 are preferably formed on the external surface of the metallic body 32 so that a tool such as a wrench can be applied to the metallic body for rotating it as it is threaded onto another article or a fitting.

Each of the above-described embodiments of an article according to the present invention is formed of a corrosion resistant, ferritic steel alloy which contains about 0.08% max. C, about 1.00% max. Mn, about 1.00% max. Si, about 0.045% max. P, about 0.0250–.3% S, about 10.5–11.75% Cr, about 0.50% max. Ni, and Cb in an amount ranging from at least about ten times the amount of carbon (10×C) up to about 0.8% max. Preferably, the alloy contains not more than about 0.03% C, better yet not more than about 0.02% C, not more than about 0.75% each of Mn and Si, not more than about 0.06% S, at least about 0.30% Ni, and not more than about 0.60% Cb.

Manganese-sulfide inclusions or stringers in the alloy benefit machinability by lowering the shear strength of the metal chips that are formed during the machining process. Such chips break and fall away from the machining tool more readily. Consequently, there is less heat generated on the cutting edges and surfaces of the machining tool. Also, a greater volume of cutting fluid can reach the tool to remove heat and provide lubrication. In either case the life of the machining tool is extended and machine downtime for retooling is reduced. The manganese sulfide inclusions also provide a lubricating effect during the machining process that permits faster machining speeds and feed rates and lower cutting forces. The last named effect results in less stress imposed on the cutting tool during metal removal, thereby extending the tool's fatigue life and reducing the risk of a catastrophic failure. For best machinability, the alloy contains at least about 0.030% S, e.g., about 0.035% or about 0.04% S and an amount of Mn that is effective to combine with at least some of the S to form manganese sulfides. To ensure the benefits derived from the presence of manganese sulfides in this alloy, an effective amount of manganese is present in this alloy when the Mn/S ratio is at least about 2–3.

Optionally, this alloy may contain up to about 0.50% max. Cu, up to about 0.50% max. Mo, and/or up to about 0.10% Al if desired. The balance of the alloy is iron except for the usual impurities which are present in similar grades of corrosion resistant ferritic steel alloys.

The alloy can be prepared in any known manner, electric arc melting followed by argon-oxygen decarburization (AOD) being the preferred melting/refining technique. The alloy is mechanically worked as by hot and/or cold working to a desired product form such as wire, rod, or bar. Useful articles such as the bushing 10, fitting 20, or housing 30 described hereinabove are formed from the alloy by first cold heading the alloy to a rough shape. The rough shape is then machined to final dimension by one or more operations such as drilling, tapping, facing, turning, form-tool shaping, and/or chamfering.

In view of the foregoing description and the accompanying drawings, some of the many novel features and advantages of the alloy and articles according to the present invention are now apparent. By carefully controlling the composition of the alloy in accordance with the present invention, there is provided a novel alloy having improved machinability compared to Type 409Cb alloy and which also provides acceptable levels of headability, weldability, and corrosion resistance. The improvements in machinability serve to significantly improve the precision with which components such as bushing 10, fitting 20, and housing 30 can be machined, to prolong the useful life of machining tools, and to improve productivity by reducing costly machine down times for retooling.

The terms and expressions which have been employed herein are used as terms of description, not of limitation. There is no intention in the use of such terms and expressions of excluding any equivalents of the features shown and described or portions thereof. However, it is recognized that various modifications are possible within the scope of the invention claimed.

What is claimed is:

1. A ferritic stainless steel alloy having a unique combination of cold-formability and machinability, said alloy consisting essentially of, in weight percent, about:

| | wt. % |
|---|---|
| Carbon | 0.08 max. |
| Manganese | 1.00 max. |
| Silicon | 1.00 max. |
| Phosphorus | 0.045 max. |
| Sulfur | 0.030–0.30 |
| Chromium | 10.5–11.75 |
| Molybdenum | 0.50 max. |
| Copper | 0.50 max. |
| Nickel | 0.50 max. |
| Aluminum | 0.10 max. |
| Columbium | 10 × C to 0.8 |

and the balance is essentially iron.

2. An alloy as recited in claim 1 which contains at least about 0.030% sulfur.

3. An alloy as recited in claim 1 which contains not more than about 0.060% sulfur.

4. An alloy as recited in claim 1 which contains at least about 0.30% nickel.

5. An alloy as recited in claim 1 which contains not more than about 0.030% carbon.

6. An article of manufacture comprising a metallic body having an axial bore formed therein and a plurality of threads formed on said metallic body whereby said metallic body can be threaded onto a second article having a mating thread, said metallic body being formed of a corrosion resistant, ferritic steel alloy having the following weight percent composition:

| | wt. % |
|---|---|
| Carbon | 0.08 max. |
| Manganese | 1.00 max. |
| Silicon | 1.00 max. |
| Phosphorus | 0.045 max. |
| Sulfur | 0.020–0.30 |
| Chromium | 10.5–11.75 |
| Molybdenum | 0.50 max. |
| Copper | 0.50 max. |
| Nickel | 0.50 max. |
| Aluminum | 0.10 max. |
| Columbium | 10 × C to 0.80 |

and the balance is essentially iron.

7. An article of manufacture as recited in claim 6 wherein the threads are internal threads formed within the axial bore of the metallic body.

8. An article of manufacture as recited in claim 7 wherein the metallic body has an external surface and a plurality of flat surfaces formed on said external surface whereby a tool can be applied to said metallic body for turning said metallic body as it is threaded onto the second article.

9. An article of manufacture as recited in claim 6 wherein the metallic body has an external surface and the threads are external threads formed on the external surface of the metallic body.

10. An article of manufacture as recited in claim 9 wherein the metallic body has a plurality of flat surfaces formed on said external surface whereby a tool can be applied to said metallic body for turning said metallic body as it is threaded onto the second article.

11. An article of manufacture as recited in any of claims 6–10 wherein the alloy contains at least about 0.030% sulfur.

12. An article of manufacture as recited in claim 11 wherein the alloy contains not more than about 0.060% sulfur.

13. An article of manufacture as recited in claim 11 wherein the alloy contains at least about 0.30% nickel.

14. An article of manufacture as recited in claim 13 wherein the alloy contains not more than about 0.030% carbon.

15. An alloy as recited in claim 2 which contains at least about 0.30% nickel.

* * * * *